US009195172B2

(12) United States Patent
Kurihara

(10) Patent No.: US 9,195,172 B2
(45) Date of Patent: Nov. 24, 2015

(54) DEVELOPING DEVICE AND IMAGE FORMING APPARATUS

(71) Applicant: Oki Data Corporation, Tokyo (JP)

(72) Inventor: Kazuteru Kurihara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/666,559

(22) Filed: Mar. 24, 2015

(65) Prior Publication Data

US 2015/0277294 A1 Oct. 1, 2015

(30) Foreign Application Priority Data

Mar. 25, 2014 (JP) ..... 2014-061425

(51) Int. Cl.
*G03G 15/08* (2006.01)

(52) U.S. Cl.
CPC ..... *G03G 15/0891* (2013.01)

(58) Field of Classification Search
CPC ..... G03G 15/0891
USPC ..... 399/254, 257
See application file for complete search history.

(56) References Cited

U.S. PATENT DOCUMENTS

2006/0029405 A1 * 2/2006 Tanaka et al. ..... 399/257

FOREIGN PATENT DOCUMENTS

JP 06332313 A * 12/1994
JP H09-218575 A 8/1997

* cited by examiner

*Primary Examiner* — Susan Lee
(74) *Attorney, Agent, or Firm* — Panitch Schwarze Belisario & Nadel LLP

(57) ABSTRACT

A developing device according to the invention develops latent images formed on an image carrier with a developer including toner carrier and toner. The developing device includes a developer container, a developer conveying member, a supply unit, a discharge unit, and a discharge prohibiting unit. The developer container contains the developer. The developer conveying member conveys the developer contained in the developer container as stirring the developer to circulate the developer in a circulation path in the developer container. The supply unit supplies at least the toner carrier to the circulation path. The discharge unit discharges excessive developer in the circulation path according to supply from the supply unit. The discharge prohibiting unit prohibits discharge of the developer from the discharge unit during a predetermined discharge prohibiting period in a case where the toner carrier is supplied from the supply unit.

11 Claims, 15 Drawing Sheets

DEVELOPING DEVICE AND IMAGE FORMING APPARATUS

CROSS REFERENCE TO RELATED APPLICATIONS

This application claims priority benefits under 35 USC, section 119 on the basis of Japanese Patent Application No. 2014-061425, the disclosure of which is incorporated herein by reference.

BACKGROUND OF THE INVENTION

1. Field of the Invention

This invention relates to a developing device and an image forming apparatus.

2. Description of Related Art

Among image forming apparatuses of electrophotographic method, a two-component development method in which latent images formed on an image carrier are developed using a developer including toner carrier and toner, has been known. With such a two-component development method, when the toner carrier is degraded along use, the toner carrier tends to have lower charge ability. A trickle development method in which excessive developer in the developer container is discharged while new developer is supplied to the developer container (see, e.g., Japanese Application Publication (A1) No. H9-218,575), has been proposed.

With such a trickle development method, however, if new toner carrier just supplied is discharged at a time that the toner carrier is supplied, a ratio of degraded toner carrier will increase as time goes, so that the quality of the images becomes low.

It is therefore an object of the invention to provide a developing device and an image forming apparatus capable of preventing new toner carrier just supplied from being discharged.

SUMMARY OF THE INVENTION

To solve the above problems, a developing device according to a first aspect of the invention, develops latent images formed on an image carrier with a developer including toner carrier and toner, and comprises a developer container containing the developer, a developer conveying member conveying the developer contained in the developer container as stirring the developer to circulate the developer in a circulation path in the developer container, a supply unit supplying at least the toner carrier to the circulation path, a discharge unit for discharging excessive developer in the circulation path according to supply from the supply unit, and a discharge prohibiting unit prohibiting discharge of the developer from the discharge unit during a predetermined discharge prohibiting period in a case where the toner carrier is supplied from the supply unit.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF EMBODIMENTS

Selected embodiments of the present invention will now be explained with reference to the drawings. It will be apparent to those skilled in the art from this disclosure that the following descriptions of the embodiments of the invention are provided for illustration only and not for the purpose of limiting the invention as defined by the appended claims and their equivalents.

First Embodiment

Figure 1:
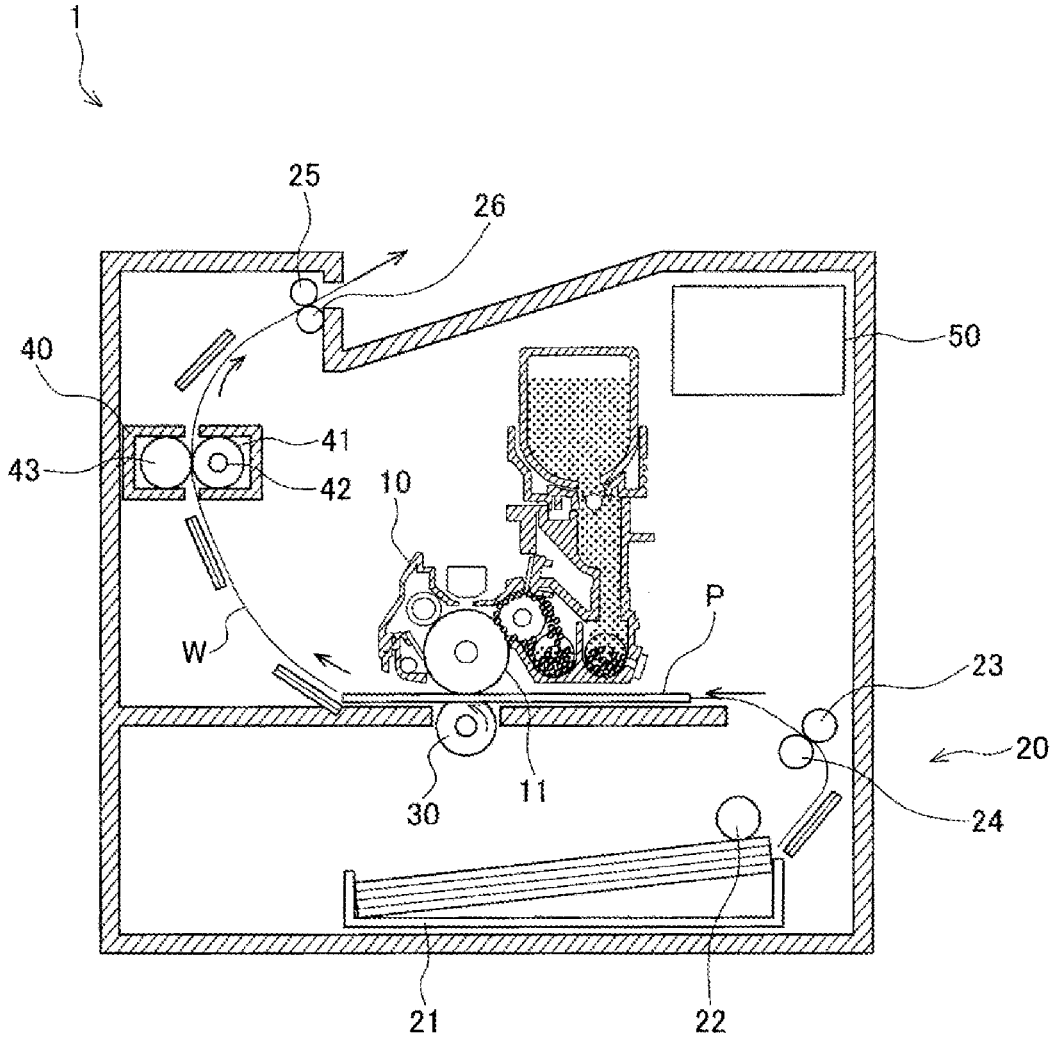
FIG. 1 is a schematic diagram showing a structure of an image forming apparatus according to a first embodiment of the invention.

FIG. 1 is a schematic diagram showing a structure of an image forming apparatus 1 according to the first embodiment. The image forming apparatus 1 is an apparatus forming images on recording media using an electrophotographic method, and is, herein, a monochrome printer. In FIG. 1, the image forming apparatus includes an image forming section 10, a medium conveyance section 20, a transfer roller 30 as a transfer device, a fixing device 40, and a control device 50.

The image forming apparatus 10 has a photosensitive drum 11 as an image carrier, and forms toner images onto the photosensitive drum 11. The image forming apparatus 10 will be described in detail below.

The medium conveyance section 20 conveys a paper P as a recording medium and supplies the paper P to the image forming section 10. The medium conveyance section 20 includes a container tray 21 for containing the paper P, a paper conveyance roller 22 for feeding sheet by sheet the paper P contained in the container tray 21, and paper conveyance rollers 23 to 26 for conveying the paper P fed by the paper conveyance roller 22 along a conveyance route W in an arrow direction in FIG. 1.

The transfer roller 30 transfers the toner images formed on the photosensitive drum 11 by means of the image forming section 10 onto the paper P supplied from the medium conveyance section 20. The transfer roller 30 is disposed facing the photosensitive drum 11 and forms a transfer section performing transfer to the photosensitive drum 11. The transfer roller 30 is formed of, e.g., a metal shaft or core covered with a urethane sponge layer.

The fixing device 40 fixes, to the paper P, toner images transferred onto the paper P by the transfer roller 30. The fixing device 40 includes a heating roller 41, a heater 42 heating the heating roller 41, and a pressure roller 43 applying pressure to the heating roller 41. When the paper P passes between the heating roller 41 and the pressure roller 43, the fixing device 40 fixes the toner images onto the paper P upon application of heat and pressure.

The control device 50 controls operations of the image forming apparatus 1. The control device 50 will be described below in detail.

Figure 2:
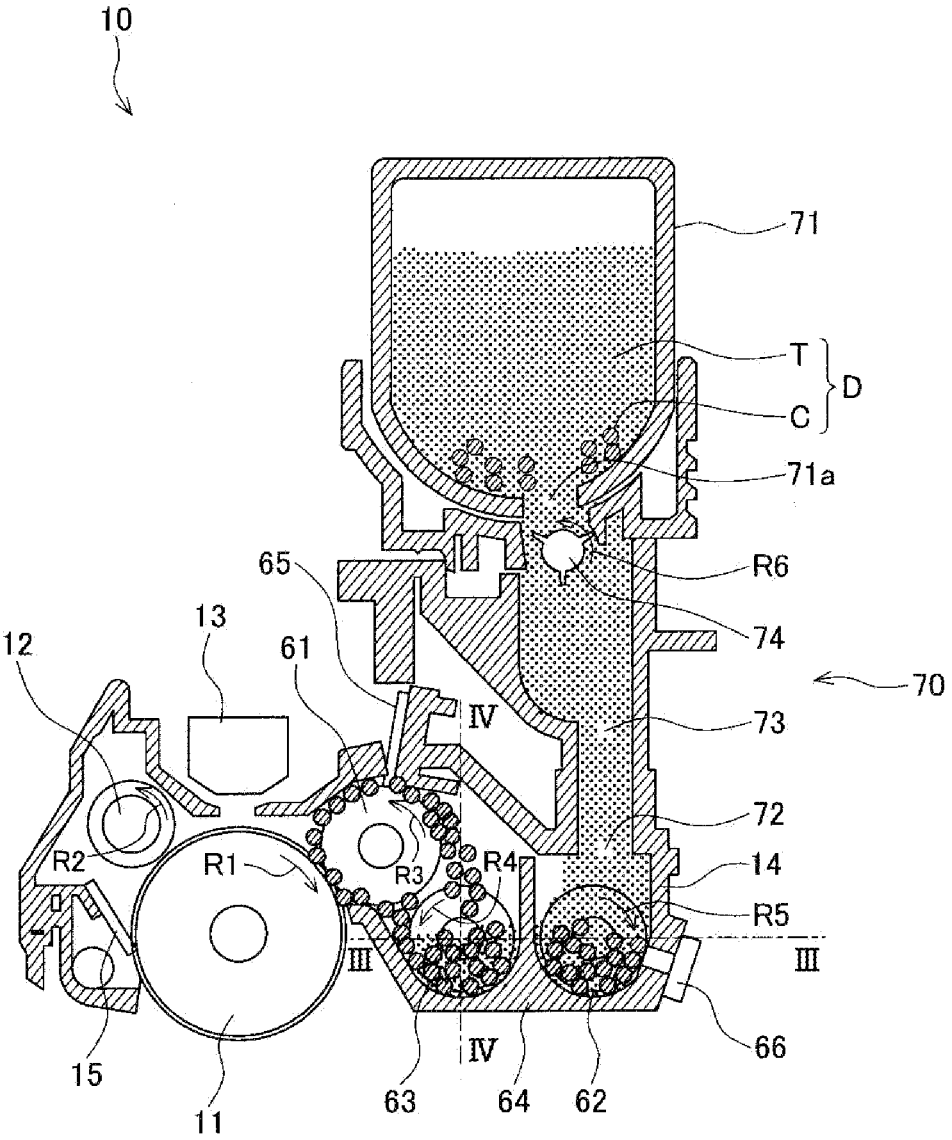
FIG. 2 is a schematic diagram showing a structure of an image forming section in the image forming apparatus shown in FIG. 1.

FIG. 2 is a schematic diagram showing a structure of the image forming section 10. In FIG. 2, the image forming section 10 includes the photosensitive drum 11, a charge roller 12 as a charge device, an LED head 13 as a latent image forming unit or an exposing device, a developing device 14, and a cleaning blade 15 as a cleaning device.

The photosensitive drum 11 is a member carrying latent images and toner images. More specifically, the photosensitive drum 11 is a cylindrical member extending in a longitudinal direction, or namely in a direction perpendicular to a drawing surface of FIG. 2. The photosensitive drum 11 has a gear or gears for drive, not shown, and rotates in arrow R1 direction in FIG. 2 according to drive force given from the gears. The photosensitive drum 11 is constituted of a conductive support and a photoconductive layer. For example, the photosensitive drum 11 is an organic photosensitive body having a metal pipe made of aluminum as the conductive support accumulating, as the photoconductive layer, a charge generation layer and a charge transfer layer. Around the photosensitive drum 11, provided along the rotational direction R1 are the charge roller 12, the LED head 13, the developing device 14, the transfer roller 30, and the cleaning blade 15, in this sequence.

The charge roller 12 charges the surface of the photosensitive drum 11. The charge roller 12 is disposed in contact or pressurized contact with the surface of the photosensitive drum 11. The charge roller 12 is a cylindrical member and rotates in an arrow direction R2 in FIG. 2. The charge roller 12 is made of, e.g., a metal shaft covered with a semiconductive epichlorohydrin rubber layer.

The LED head 13 forms latent images on the photosensitive drum 11. More specifically, the LED head 13 is disposed facing the photosensitive drum 11, and exposes the surface of the photosensitive drum 11 charged by the charge roller 12, thereby forming the electrostatic latent images on the surface.

The developing device 14 develops the latent images formed on the photosensitive drum 11 using a developer D including toner carrier C and toner T. The developing device 14 is a developing device for a trickle development method. Herein, the toner T is made of binding resin, charge controlling agent as internal additive, mold releasing agent, colorant, and external additive. The toner carrier C is a magnetic carrier and is made of particles having magnetism.

The cleaning blade 15 is a member removing toner remaining on the surface of the photosensitive drum 11 after the transfer, and is made of, e.g., an urethane rubber.

Hereinafter, the structure of the developing device 14 is described in detail. The developing device 14 includes a developing sleeve 61, a developing container 62, developer conveyance screws 63, 64 serving as developer conveyance members, a doctor blade 65 serving as a thin layer forming device, and a toner density sensor 66 serving as a toner density detector.

The developing sleeve 61 carries the developer D and develops the latent images formed on the photosensitive drum 11 with the developer D, thereby forming the toner image on the photosensitive drum 11. More specifically, the developing sleeve 61 is a cylindrical member extending along the longitudinal direction of the photosensitive drum 11. The developing sleeve 61 is disposed facing the photosensitive drum 11 with a prescribed gap (herein, 500 micron meters). The developing sleeve 61 has a gear or gears for drive, not shown, and rotates in the arrow direction R3 in FIG. 2 according to the drive force given from the gears. The developing sleeve 61 is made of, e.g., a metal pipe whose surface is finished with blasting treatment, and at an inside of the pipe, a magnetic body is placed for generating a prescribed magnetic flex density distribution on the developing sleeve 61.

Figure 3:
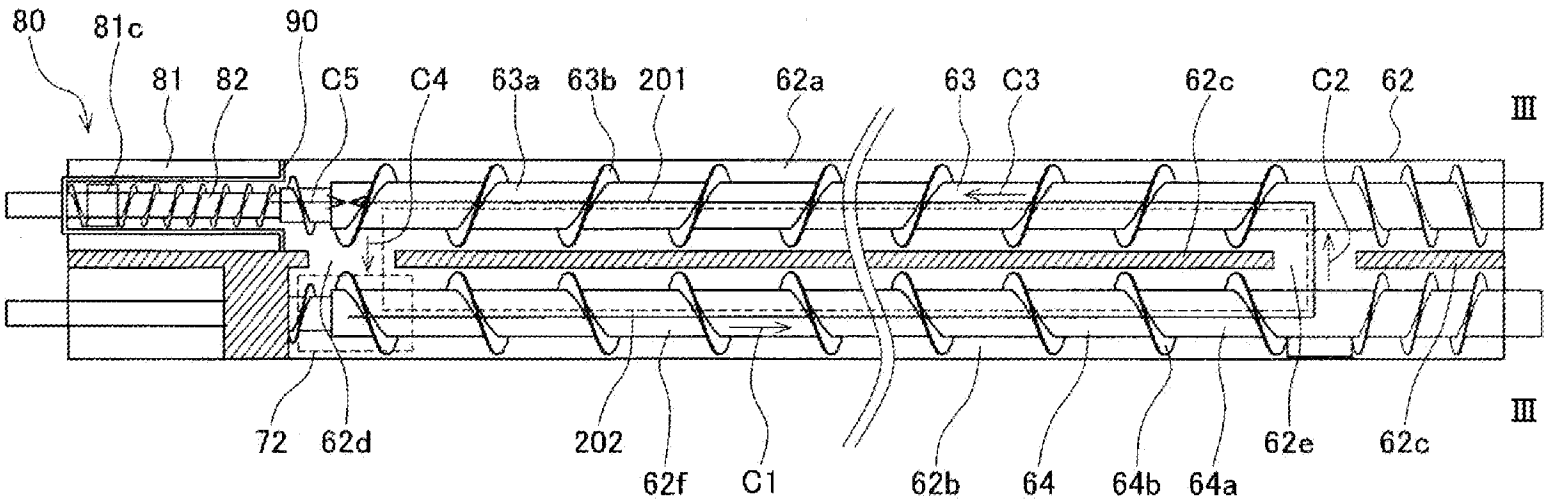
FIG. 3 is a cross section cut along III-III line in FIG. 2.

The developing container 62 contains the developer D supplied to the developing sleeve 61. FIG. 3 is a cross section cut along III-III line in FIG. 2, and shows the structure of the developing container 62 schematically. As shown in FIG. 3, the developing container 62 has a first conveyance path 62*a*, a second conveyance path 62*b*, and a partition member 62*c*. The first conveyance path 62*a* and the second conveyance path 62*b* are passages for conveying the developer D and extend in the longitudinal direction of the developing sleeve 61. The first conveyance path 62*a* is disposed so adjacently to the developing sleeve 61 that the developer D located inside the path is supplied to the developing sleeve 61. The second conveyance path 62*b* is provided on the opposite side to the developing sleeve 61 with respect to the first conveyance path 62*a*. The partition member 62*c* extends along the longitudinal direction of the developing sleeve 61, and divides the space into the first conveyance path 62*a* and the second conveyance path 62*b*. Openings 62*d*, 62*e* are formed near each end of the partition member 62*c* respectively for communicating the first conveyance path 62*a* with the second conveyance path 62*b*.

The developer conveyance screws 63, 64 convey the developer D contained in the developing container 62 as stirring the developer and make the developer D circulate in a circulation path 62*f* within the developing container 62. In the example shown in FIG. 3, the developer conveyance screws 63, 64 are structured to render the developer D in the developing container 62 circulate through the second conveyance path 62*b*, the opening 62*e*, the first conveyance path 62*a*, and the opening 62*d* in this sequence as shown with arrows C1 to C4. That is, the circulation path 62*f* is formed of the second conveyance path 62*b*, the opening 62*e*, the first conveyance path 62*a*, and the opening 62*d*.

More specifically, the developer conveyance screw 63 is disposed in the first conveyance path 62*a*. The developer conveyance screw 63 includes a rotation shaft 63*a* extending along the first conveyance path 62*a*, and a vane 63*b* formed around the rotation shaft 63*a* within the first conveyance path 62*a*. The rotation shaft 63*a* is rotatably supported to the developing container 62 at each end in the longitudinal direction of the shaft. The developer conveyance screw 63 has a gear or gears for drive, and rotates in an arrow R4 direction in FIG. 2 according to drive force given to the gear.

The developer conveyance screw 64 is disposed within the second conveyance path 62*b*. The developer conveyance screw 64 includes a rotation shaft 64*a* extending along the second conveyance path 62*b*, and a vane 64*b* formed around the rotation shaft 64*a*. The rotation shaft 64*a* is rotatably supported to the developing container 62 at each end in the longitudinal direction of the shaft. The developer conveyance screw 64 has a gear or gears for drive, and rotates in an arrow R5 direction in FIG. 2 according to drive force given to the gear.

The vanes 63*b*, 64*b* of the developer conveyance screws 63, 64 are structured so that the developer D in the developer container 62 circulates through the circulation path 62*f* when the developer conveyance screws 63, 64 rotate.

As viewed from FIG. 2, the doctor blade 65 limits a layer thickness of the developer D on the developing sleeve 61, and forms a thin layer of the developer D on the developing sleeve 61. The doctor blade 65 is disposed fading the developing sleeve 61 on a downstream side of the developing container 62 and on an upstream side of the photosensitive drum 11 in the rotation direction R3 of the developing sleeve 61. A prescribed gap (herein 600 micron meters) is formed between the developing sleeve 61 and the doctor blade 65. The doctor blade 65 is made of, e.g., a metal.

The toner density sensor 66 detects the toner density in the developer D in the developing container 62. The toner density sensor 66 is a permeability detection type sensor, and detects the toner density by measuring the permeability of the developer D in the developing container 62.

The developing device 14 further includes a supply unit 70 for supplying the developer D into the circulation path 62*f* of the developing container 62, and a discharge unit 80 for discharging or discarding excessive developer D in the circulation path 62*f* due to supply from the supply unit 70.

The supply unit 70 includes a developer cartridge 71, a developer supply inlet 72, a developer supply path 73, and a developer supply shutter 74.

The developer cartridge 71 is a developer container containing the developer D to be supplied in which the toner carrier C and the toner are mixed with a prescribed ratio. The developer cartridge 71 is disposed above the developing container 62. A discharge outlet 71*a* for discharging the developer D is formed below the developer cartridge 71.

The developer supply inlet 72 is an opening for supplying the developer D from the developer cartridge 71 to the developing container 62. The developer supply inlet 72 is formed at a top of the developing container 62 as shown in FIG. 2. As shown in FIG. 3, the developer supply inlet 72 is formed near the opening 62*d* on one end side of the second conveyance path 62*b*.

The developer supply path 73 is a path introducing the developer D contained in the developer cartridge 71 into the developer container 62. The developer supply path 73 makes the discharge outlet 71*a* of the developer cartridge 71 and the developer supply inlet 72 communicate each other.

The developer supply shutter 74 is a member opening and closing the discharge outlet 71*a* of the developer cartridge 71. The developer supply shutter 74 is made open while developer D is supplied from the developer cartridge 71 to the developing container 62, and is made closed other than that. The developer supply shutter 74 is herein a shutter of a rotary type, and discharges the developer D in the developer cartridge 71 toward the developer supply path 73 according to rotation in the arrow R6 direction in FIG. 2.

The discharge unit 80 discharges the developer D of an excessive portion which exceeds the prescribed amount, in a case where the developer D in the circulation path 62*f* exceeds the prescribed amount due to supply of the developer D from the supply unit 70. The discharge unit 80 is constituted of a discharge side end 81 of the developing container 62 and a discharge side end 82 of the developer conveyance screw 63.

Figure 4A:
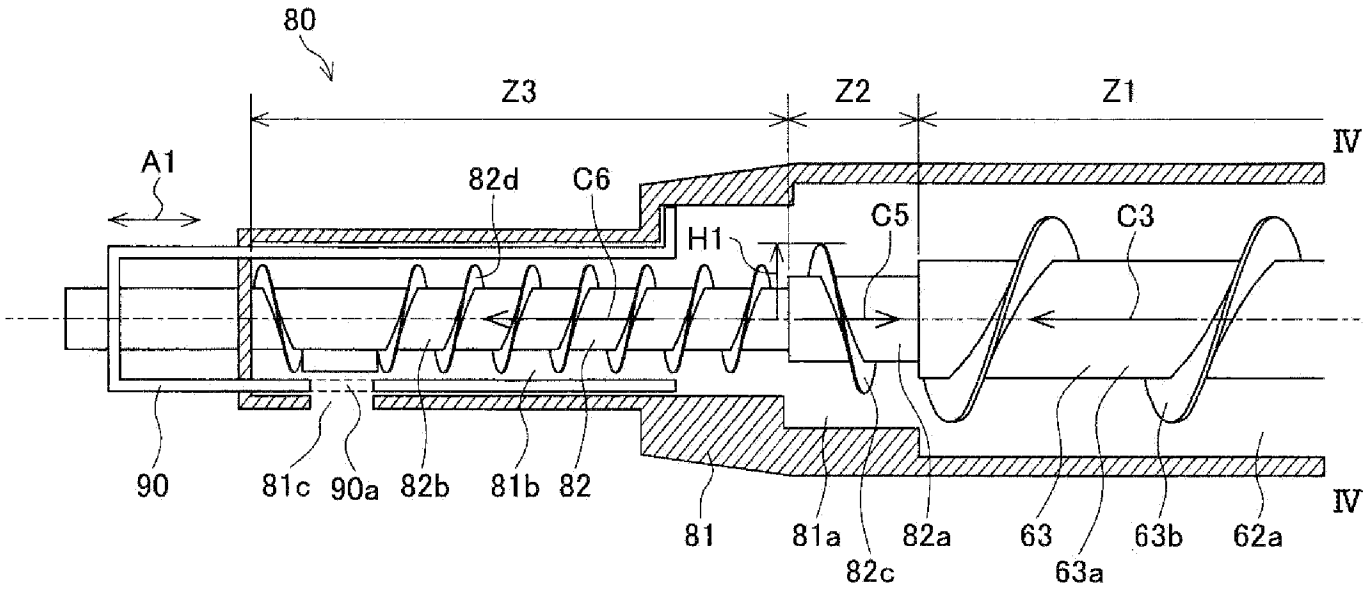
FIGS. 4A, 4B are cross sections cut along IV-IV line in FIG. 2.
Figure 4B:
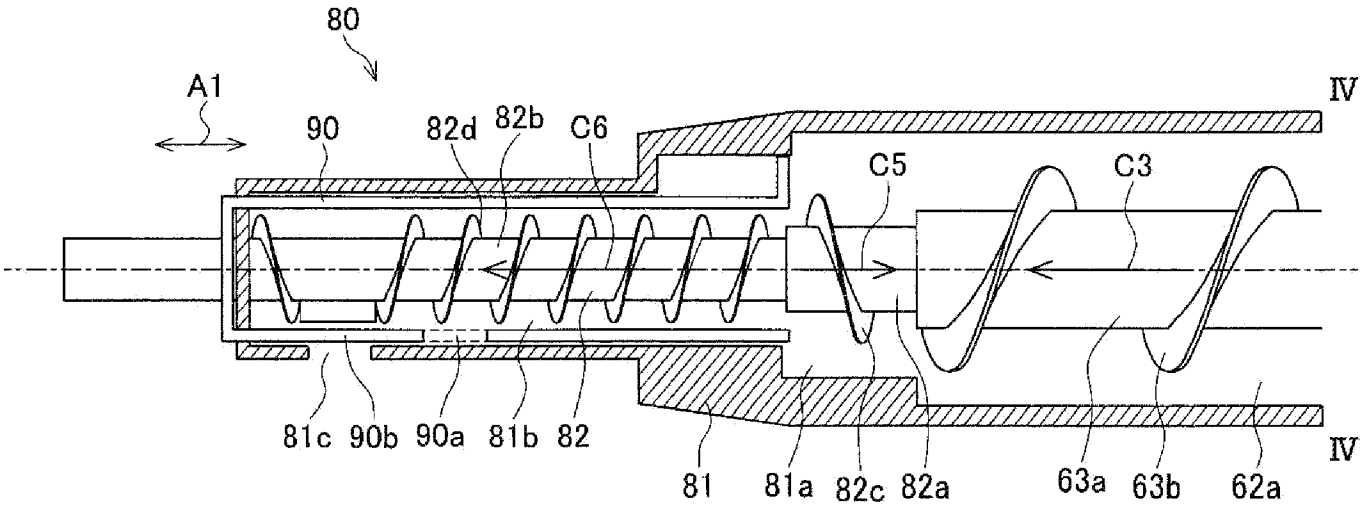

FIG. 4 is a cross section cut along Iv-Iv in FIG. 2 and shows the structure of the discharge unit 80 schematically. FIG. 4A shows a state that the discharge of the developer D done by the discharge unit 80 is allowed, and FIG. 4B shows a state that the discharge of the developer D done by the discharge unit 80 is prohibited.

As shown in FIG. 4, the discharge side end 81 of the developing container 62 includes a discharge developer selection path 81*a* in communication with the first conveyance path 62*a*, a discharge developer conveyance path 81*b* in communication with discharge developer selection path 81*a*, and a developer discharge outlet 81*c*. In FIG. 4, sections Z1, Z2, and Z3 are sections indicating the first conveyance path 62*a*, the discharge developer selection path 81*a*, and the discharge developer conveyance path 81*b*, respectively. The developer discharge outlet 81*c* is located at an end of the discharge developer conveyance path 81*b* opposite to the discharge developer selection path 81*a*, and is formed below the discharge developer conveyance path 81*b*.

The discharge side end 82 of the developer conveyance screw 63 includes a discharge developer selection unit 82*a* located in the discharge developer selection path 81*a*, and a discharge developer conveyance unit 82*b* located in the discharge developer conveyance path 81*b*. The discharge developer selection unit 82*a* has a vane 82*c* orienting oppositely to the orientation of the vane 63*b* on the side of the first conveyance path 62*a*, and generates conveyance force in a direction (arrow C5 direction in FIG. 4) opposite to the conveyance force (arrow C3 direction in FIG. 4) of the developer D in the first conveyance path 62*a*. The vane 82*c* has a height H1 extending from, as a reference, a center axis line of the rotation shaft 63*a* of the developer conveyance screw 63. The discharge developer conveyance unit 82*b* has a vane 82*d* orienting in the same direction to the orientation of the vane 63*b* on the side of the first conveyance path 62*a*, and generates conveyance force in the same direction (arrow C6 direction in FIG. 4) to the conveyance force (arrow C3 direction in FIG. 4) of the developer D in the first conveyance path 62*a*. The discharge developer conveyance unit 82*b* conveys, in the arrow C6 direction, the developer D passing over the discharge developer selection unit 82*a*, and discharges the developer D out of the developing container 62 from the developer discharge outlet 81*c*.

Where the supply unit 70 supplies the developer D to the developing container 62, if the developer D containing new toner carrier C just supplied is discharged from the discharge unit 80, the ratio of the degraded toner carrier C in the developer D increases, thereby making the image quality low. More specifically, when the developer D is supplied, the volume of the developer locally increases at a portion that the developer D is supplied, the developer D including the toner carrier C newly just supplied and not degraded may be discharged at the discharge unit 80. In such a case, the degraded toner carrier C and the not degraded toner carrier C may not be replaced efficiently with each other, and the ratio of the degraded toner carrier may increase. The charge amount of the toner is, therefore, deviated, and fogging in which toner attaches to non-printing portions on the photosensitive drum 11 may occur.

With the embodiment, from a viewpoint preventing new toner carrier C just supplied from being discharged, the developing device 14 includes a developer discharge shutter 90 as a discharge prohibiting unit. The developer discharge shutter 90 is controlled by the control device 50, and prohibits or cut off the discharge of the developer D out of the discharge unit 80 during a prescribed discharge prohibiting period where the developer D is supplied from the supply unit 70. More specifically, the developer discharge shutter 90 is a member rendering the developer discharge outlet 81*c* open and closed, and closes the developer discharge outlet 81*c* when prohibiting the developer D from discharging, whereas making the outlet 81*c* open other than the above situation. Herein, the developer discharge shutter 90 is a cylindrical member inserted into discharge developer conveyance path 81*b*, and the discharge opening 90*a* is formed at a part of a lower portion of the shutter 90. The developer discharge shutter 90 has a gear or gears for drive, not shown, and moves in the arrow A1 direction in FIGS. 4A, 4B according to drive force given to the gear between an opening position shown in FIG. 4A and a closed position shown in FIG. 4B. The discharge opening 90*a* of the developer discharge shutter 90 and the developer discharge outlet 81*c* coincide to each other at the opening position, thereby allowing discharge of the developer D out of the developer discharge outlet 81*c*. To the contrary, a wall portion 90*b* of the developer discharge shutter 90 closes the developer discharge outlet 81*c* at the closed position, thereby prohibiting the developer D from discharging out of the developer discharge outlet 81*c*.

Figure 5:
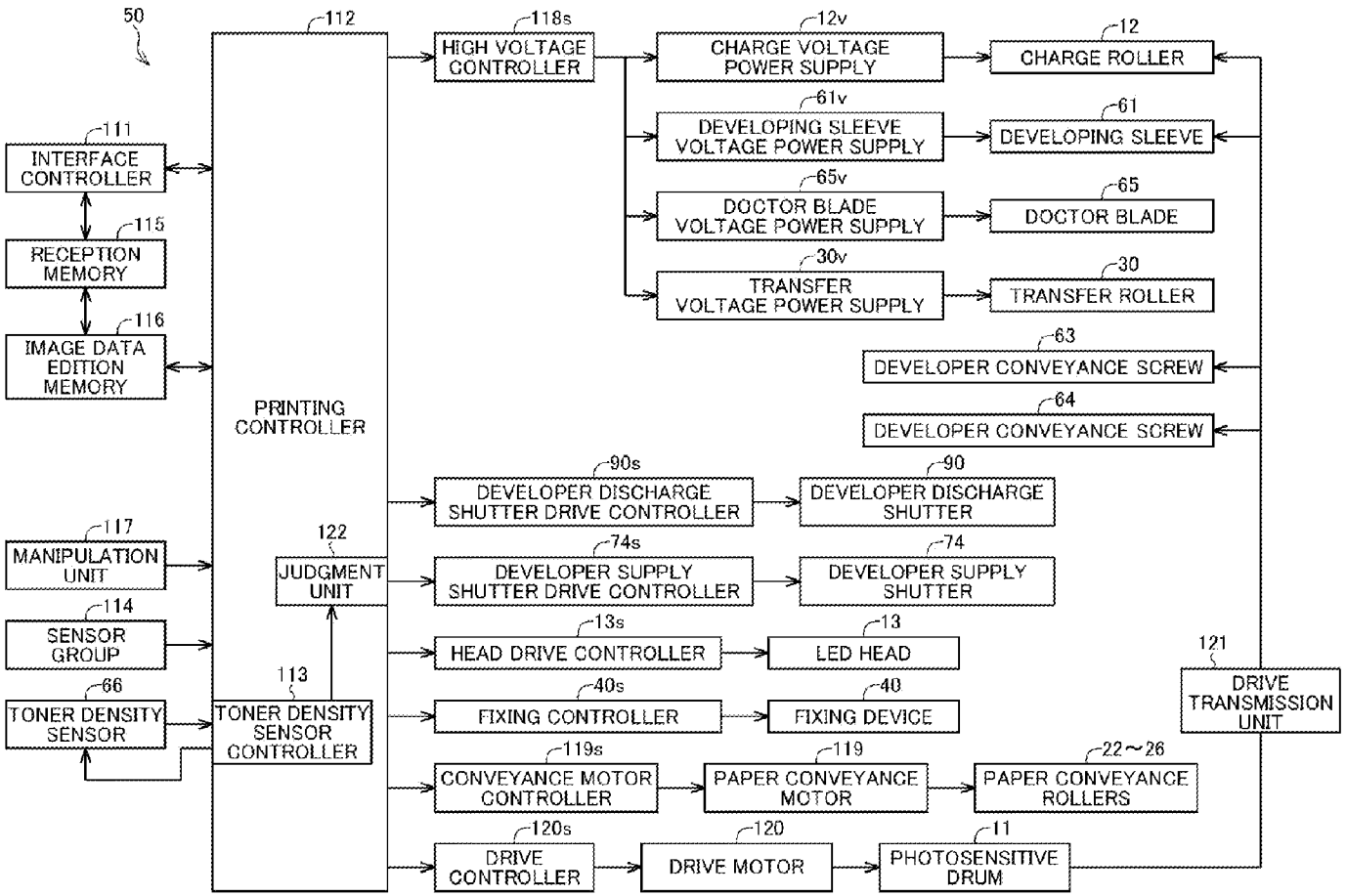
FIG. 5 is a block diagram showing the structure of the image forming apparatus according to the first embodiment.

FIG. 5 is a block diagram showing a structure of the image forming apparatus 1. Hereinafter, referring to FIG. 5, a structure relating to the control of the image forming apparatus 1 is described.

In FIG. 5, the control device 50 includes an interface (I/F) controller 111, a printing controller 112, a reception memory 115, an image data edition memory 116, a manipulation unit 117, a high voltage power supply controller 118*s*, a charge voltage power supply 12*v*, developing sleeve voltage power supply 61*v*, a doctor blade voltage power supply 65*v*, a transfer voltage power supply 30*v*, a developer supply shutter drive controller 74*s*, a developer discharge shutter drive controller 90*s*, a head drive controller 13*s*, a fixing controller 40*s*, a conveyance motor controller 119*s*, and a drive controller 120*s*.

The interface controller 111 receives print data and control commands from a host apparatus such as, e.g., a personal computer, not shown.

The printing controller 112 receives the print data and the control commands from the host apparatus via the interface controller 111, controls the entire sequences of the image forming apparatus 1, and makes printing of the print data. The printing controller 112 is structured of, e.g., a microprocessor, ROMs (Read Only Memory), RAMs (Random Access Memory), input and output ports, and a timer. The printing controller 112 has a toner density sensor controller 113. The toner density sensor controller 113 controls the control voltage of the toner density sensor 66, thereby retrieving the detection result of the toner density sensor 66. The printing controller 112 is connected to a sensor group 114, and controls operation of the image forming apparatus 1 based on the output from the sensor group 114. The sensor group 114 includes various sensors for monitoring operation of the image forming apparatus 1 and status of the periphery of the apparatus 1, such as, e.g., a paper position detection sensor for detecting the position original document the paper P in the conveyance path W, a temperature and humidity sensor for detecting temperature and humidity of a surrounding of the image forming apparatus 1, a printing density sensor for detecting the density of the toner image formed by the image forming unit 10, and a developer remaining amount detection sensor for detecting the remaining amount of the developer D in the developer cartridge 71.

The reception memory 115 temporarily memorizes printing data entered from the host apparatus via the interface controller 111.

The image data edition memory 116 receives the printing data memorized in the reception memory 115, and memorizes the image data produced by edition processing on the printing data.

The manipulation unit 117 receives the instructions from an operator. The manipulation unit 117 has a display unit displaying information for the operator such as, e.g., a status of the image forming apparatus 1, and an input unit such as, switches, for receiving instructions from the operator.

The high voltage power supply controller 118*s*, controls the voltage applying to respective portions of the image forming apparatus 1 according to the instruction from the printing controller 112.

The charge voltage power supply 12*v* applies a voltage designated from the high voltage power supply controller 118*s* to the charge roller 12. The charge voltage power supply 12*v* applies a voltage designated from the high voltage power supply controller 118*s* to the charge roller 12. The developing sleeve voltage power supply 61*v* applies a voltage designated from the high voltage power supply controller 118*s* to the developing sleeve 61. The doctor blade voltage power supply 65*v* applies a voltage designated from the high voltage power supply controller 118*s* to the doctor blade 65. The transfer voltage power supply 30*v* applies a voltage designated from the high voltage power supply controller 118*s* to the transfer roller 30.

The developer supply shutter drive controller 74*s* controls the opening and closing operations of the developer supply shutter 74 formed with the developer cartridge 71 according to the instructions from the printing controller 112. The developer discharge shutter drive controller 90*s* controls the opening and closing operations of the developer discharge shutter 90 formed with the developing device 14 according to the instructions from the printing controller 112.

The head drive controller 13*s* sends image data memorized in the image data edition memory 116 to the LED head 13 and drives the LED head 13.

The fixing controller 40*s* supplies electric power to the fixing device 40 to fix the toner images transferred onto the paper P to the paper P. More specifically, the fixing controller 40*s* reads the output of the temperature sensor not shown for detecting the temperature of the heating roller 41, and based on the output, controls a current passage to the heater 42 so as to make the heating roller 41 at a constant temperature.

The conveyance motor controller 119*s* controls a paper conveyance motor 119 for driving the paper conveyance rollers 22 to 26, and conveys as well as stops the paper P at a prescribed timing according to the instructions from the printing controller 112.

The drive controller 120*s* drives a drive motor 120 for rotating the photosensitive drum 11 according to the instructions from the printing controller 112. Drive force from the drive motor 120 is transmitted to a drive transmission unit 121 via the photosensitive drum 11, and further transmitted to the charge roller 12, the developing sleeve 61, and the developer conveyance screws 63, 64, by the drive transmission unit 121.

Next, functions of the printing controller 112 regarding the supply and discharge of the developer D are described.

The printing controller 112 has a judgment unit 122 judging as to whether the developer D is to be supplied based on a use state of the developer D in the circulation path 62*f* or the developing container 62. In this embodiment, the judgment unit 122 judges as the developer D is to be supplied where the toner density is lower than a predetermined threshold value based on the detection consequence of the toner density sensor 66. The judgment unit 122, however, can make a judgment with other methods, and for example, can make a judgment as to supply the developer D when the accumulated printing sheet number or accumulated printing dot number exceeds each threshold value.

Where the judgment unit 122 judges that the developer D is to be supplied, the printing controller 112 makes open the developer supply shutter 74 for a prescribed period from the developer supply shutter drive controller 74*s*. With this operation, the supply unit 70 supplies the developer D in a prescribed amount into the circulation path 62*f*. In this embodiment, the prescribed amount is variable and is decided according to the images to be printed. More specifically, the printing controller 112, based on the image data memorized in the image data edition memory 116, makes longer the open period of the developer supply shutter 74 and makes more the supply amount of the developer D, as more the dot number to be printed exists. The prescribed amount can be a predetermined fixed value.

Where the supply unit 70 supplies the developer D, the printing controller 112 makes closed the developer discharge shutter 90 during the prescribed discharge prohibiting period from the developer discharge shutter drive controller 90*s*. With this operation, the developer discharge shutter 90 serving as a discharge prohibiting unit prohibits the developer D from discharging out of the discharge unit 80 during the discharge prohibiting period.

The discharge prohibiting period includes at least a part of a period that the toner carrier C supplied from the supply unit 70 passes through the discharge unit 80. Herein, the period that the toner carrier C supplied from the supply unit 70 passes through the discharge unit 80 means a period from a timing that the supplied toner carrier C reaches the discharge unit 80 to a timing that the toner carrier C finishes passing through the discharge unit 80, and more particularly, the passing period means a period from a timing that a front end of the distribution of the supplied toner carrier C reaches the discharge unit 80 to a timing that a rear end of the distribution of the supplied toner carrier C finishes passing through the discharge unit 80, because the supplied toner carrier C is conveyed as stirred by the developer conveyance screws 63, 64 and made spread in the conveyance direction.

In one embodiment, a start timing of the discharge prohibiting period is prior to a timing that the toner carrier C supplied from the supply unit 70 reaches the discharge unit 80. An end timing of the discharge prohibiting period is subsequent to a timing that the toner carrier C supplied from the supply unit 70 passes through the discharge unit 80.

In operation of the image forming apparatus 1, with reference to FIGS. 1 to 5, if a printing command is entered from the host apparatus, the printing controller 112 drives the drive motor 120 via the drive controller 120*s*, and rotates the photosensitive drum 11 in the arrow R direction at a constant circumferential speed. Where the drive transmission unit 121 transmits the drive force from the rotation of the photosensitive drum 11, the charge roller 12 rotates in the arrow R2 direction; the developing sleeve 61 rotates in the arrow R3 direction; and the developer conveyance screws 63, 64 rotate in the arrows R4, R5 directions, respectively. The printing controller 112 applies a voltage from the charge voltage power supply 12*v* to the charge roller 12 via the high voltage power supply controller 118*s* and charges the surface of the photosensitive drum 11 uniformly. The printing controller 112 then drives the LED head 13 via the head drive controller 13*s* based on the image data memorized in the image data edition memory 116. With this operation, light corresponding to the image data is radiated from the LED head 13 to the charged surface of the photosensitive drum 11, thereby forming latent images onto the photosensitive drum 11. The electrostatic latent images formed on the photosensitive drum 11 are developed with the toner T according the development operation of the developing device 14 as described below, and toner images are formed onto the photosensitive drum 11.

To the contrary, the paper P contained in the container tray 21 is conveyed by the paper conveyance rollers 22 to 24, and sent to a transfer unit located between the photosensitive drum 11 and the transfer roller 30. The transfer roller 30 receives application of a direct current voltage from the transfer voltage power supply 30*v*, and transfers the toner images formed on the photosensitive drum 11 onto the paper P. The paper P with the transferred toner images is further conveyed to the fixing device 40. At the fixing device 40, the toner images on the paper P are melt in application of heat and pressure, immerged into fibers of the paper P, and fixed to the paper P. The paper P with the fixed toner images is sent out of the image forming apparatus 1 by means of the paper conveyance rollers 25, 26.

The toner T in a certain amount may remain on the surface of the photosensitive drum 11 after the transfer operation. The remaining toner T is removed by the cleaning blade 15. The surface of the photosensitive drum 11 after cleaning operation is used for image formation again, and thus, the photosensitive drum 11 is used repetitively.

Hereinafter, referring to FIG. 2 and FIG. 3, the development operation of the developing device 14 is described. In the developing container 62, the developer D is conveyed as stirred with the developer conveyance screws 63, 64. The toner T, at that time, is charged at a prescribed polarity (i.e., negative in this embodiment) according to friction with the toner carrier C. The developer D in the first conveyance path 62*a* is drawn up with the developing sleeve 61 to which the developing sleeve voltage power supply 61*v* applies a prescribed voltage (e.g., −500 V) according to magnetic force from the developing sleeve 61. The drawn-up developer D forms magnetic bristles from a prescribed magnetic flux density distribution on the developing sleeve 61. The magnetic bristles formed on the developing sleeve 61 are sliced to have a proper length by means of the doctor blade 65 to which the doctor blade voltage power supply 65*v* applies a prescribed voltage (e.g., −500 V). The developer D formed on the developing sleeve 61 passing through the doctor blade 65 reaches a portion facing the photosensitive drum 11 according to the rotation of the developing sleeve 61. The toner T charged negatively in the developer D is attached to the electrostatic latent images formed on the photosensitive drum 11 at the facing portion, thereby forming toner images on the photosensitive drum 11. In this embodiment, the developing sleeve 61 and the doctor blade 65 are set to the same potential, but can be set with a potential difference to charge them at a time that the developer D is sliced.

Next, referring to FIGS. 2, 3, supply operation of the developer D is described. The developer D supplied onto the developing sleeve 61 from the first conveyance path 62*a* is collected again into the first conveyance path 62*a* after the toner T is consumed through the development operation. The collected developer D is conveyed along the circulation path 62*v* with the developer conveyance screws 63, 64, and the toner density in the conveyed developer D is detected with the toner density sensor 66. Where judging that the toner density detected by the toner density sensor 66 is lower than a preset threshold value, the printing controller 112 makes open the developer supply shutter 74, thereby supplying the developer D in the developer cartridge 71 from the developer supply inlet 72 to the second conveyance path 62*b*. The supplied developer D is conveyed as stirred with the developer conveyance screws 63, 64 and mixed with the existing developer D. As described above, the developer D is supplied from the developer cartridge 71 so as to maintain the desired toner density.

Referring to FIGS. 2, 4, discharge operation of the developer D is described. According to the supply of the developer D from the supply unit 70, the amount of the developer D in the developing container 62 increases. With this increased amount, if the height of the developer D exceeds the height H of the vane 82*c* of the developer conveyance screw 63 in the discharge developer selection path 81*a* (section Z2 in FIG. 4), the conveyance force in the arrow C5 direction in FIG. 4 does not work the portion exceeding the height H, and the developer D of the portion exceeding the height H is conveyed to the discharge developer conveyance path 81*b* (section Z3 in FIG. 4). The developer D is conveyed in the arrow C6 direction in FIG. 4 according to the vane 82*d* of the developer conveyance screw 63, and is discharged from the discharge opening 90*a* and the developer discharge outlet 81*c*. The discharged developer D is preserved in the discharge developer storing container, not shown. As described above, the developing device 14 discharges the developer D so as to maintain the desired developer amount.

Figure 6:
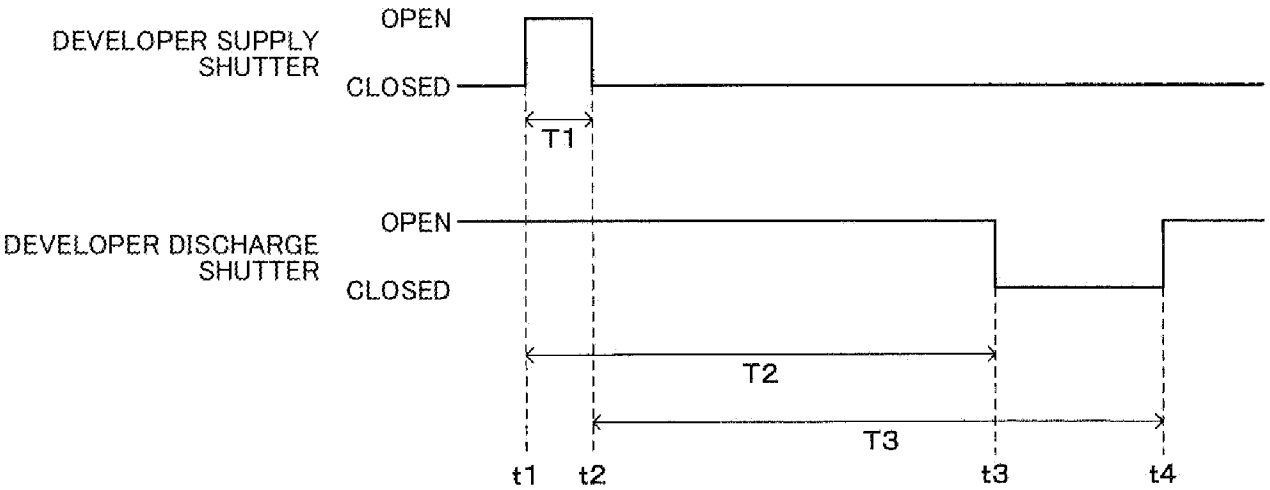
FIG. 6 is a control sequence diagram of a developer supply shutter and a developer discharge shutter according to the first embodiment.

FIG. 6 is a control sequence diagram of a developer supply shutter 74 and a developer discharge shutter 90, and shows timings of opening and closing of each shutter. Hereinafter, referring to FIG. 6, the discharge prohibiting operation of the developer D is described.

The printing controller 112 makes the developer supply shutter 74 open at a timing t1. The developer D is supplied at the same time as the developer supply shutter 74 is made open, and the supplied developer D is conveyed along the circulation path 62*f*.

The printing controller 112 measures lapse time from the timing t1, and makes the developer supply shutter 74 closed at a timing that the measured lapse time reaches time T1 or namely timing t2. With this operation, the supply of the developer D is stopped. The time T1 is determined according to, e.g., image data to be printed.

The printing controller 112 makes closed the developer discharge shutter 90 at a timing that the lapse time from the timing t1 reaches a time T2 or namely at a timing t3. In this embodiment, the time T2 is a required time for the toner carrier C supplied from the supply unit 70 to reach the discharge unit 80, or specifically, the discharge developer selection path 81*a*, and the timing t3 is a time point that the toner carrier C supplied from the supply unit 70 reaches the discharge unit 80. The required time may be measured through experiments or may be calculated. For example, where a distance along the circulation path 62*f* from the developer supply inlet 72 to the discharge developer selection path 81*a*, or a length of a route 201 shown with a solid line in FIG. 3, is set to S, and where a conveyance speed of the toner carrier C is set to Vd, the time T2 is calculated from a formula (i) below.

$$T2=S/Vd \quad \text{(i)}$$

The conveyance speed Vd is measured from, e.g., experiments. Herein, because the toner carrier C supplied from the supply unit 70 is conveyed as stirred and mixed well, the conveyance speed of the toner carrier C is not uniform, and generates a certain distribution. In consideration of this distribution, the maximum value of the conveyance speed distribution of the toner carrier C is used for the conveyance speed Vd in the formula (i) so as not to discharge the toner carrier C first reaching the discharge unit 80. In a case that the conveyance speed distribution has a narrow width, an average value may be used.

The printing controller 112 measures lapse time from the timing t2, and makes open the developer discharge shutter 90 at a timing that the measured lapse time reaches the time T3 or namely at a timing t4. In this embodiment, the time T3 is a required time for the toner carrier C supplied from the supply unit 70 to circulate once around the conveyance path 62*f*. More specifically, the timing t4 is a time point that a rear end of the distribution of the toner carrier C supplied from the supply unit 70 reaches again a portion of the developer supply inlet 72. The required time may be measured through experiments or may be calculated. For example, where a length of the circulation path 62*f*, or a length of a route 202 shown with a broken line in FIG. 3, is set to L, and where a conveyance speed of the toner carrier C is set to Vd, the time T3 is calculated from a formula (ii) below.

$$T3=L/Vd \quad \text{(ii)}$$

In consideration of the distribution of the conveyance speed of the toner carrier C, the minimum value of the conveyance speed distribution of the toner carrier C is used for the conveyance speed Vd in the formula (ii). In a case that the conveyance speed distribution has a narrow width, an average value may be used.

In FIG. 6, a period from the timing t3 to the timing t4 is the discharge prohibiting period, and the developer D is prohibited from being discharged during the discharge prohibiting period.

The controls of the developer supply shutter 74 and the developer discharge shutter 90 as described above are performed during the printing operation, but may be performed during a period other than the printing operation, such as, e.g., a period after printing operation.

Figure 7:
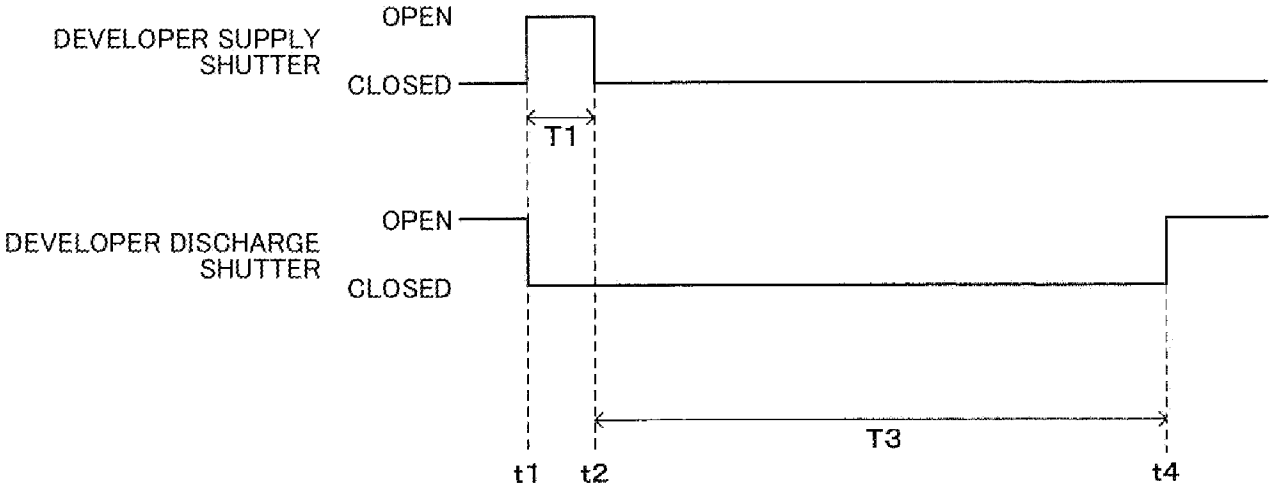
FIG. 7 is a control sequence diagram of a developer supply shutter and a developer discharge shutter according to a modification of the first embodiment.

It is to be noted that with the structure described above, a time shorter than the required time that the toner carrier C supplied from the supply unit 70 reaches the discharge unit 80 may be set as the time T2. As shown in FIG. 7, the printing controller 112 may make the developer discharge shutter closed at the timing t1. That is, the start timing of the discharge prohibiting period can be the same timing as the start of the supply of the developer D done by the supply unit 70. The term "same timing" herein means not only "perfectly the same timing" but also "substantially the same timing." The discharge prohibiting period thus may start simultaneously with the supply start of the developer D by the supply unit 70.

The time T3 may be set to a required time for the toner carrier C supplied from the supply unit 70 to completely pass through the discharge unit 80 or namely the discharge developer selection path 81*a* or to a time longer than the required time. For example, an adequately long time can be set as the time T3 so that the developer discharge shutter 90 is made open after the developer D in the circulation path 62*f* becomes uniform.

The following evaluations were made to confirm advantages of the embodiment. In these evaluations, the image forming apparatus 1 according to the first embodiment was used under the circumstance of the temperature 23 degrees Celsius and the relative humidity 45%, with a setting of a printing speed 200 mm/s, which is equal to the line speed of the photosensitive drum 11 and the conveyance speed of the paper P, to perform printing of 20,000 sheets in lateral feed (i.e., two longer edges among four edges become front and rear ends) of A4 standard paper (e.g., excellent white paper made by Oki Data Corp., 80 g/m$^2$ as basis weight) with 5% duty. It is to be noted that an indication of 100% duty means a printing of the 100% area ratio made over a printable range of an A4 single sheet paper with a whole range solid printing.

During this test, evaluations of fogging were made at each printing of 2,000 sheets. For the evaluations of fogging, a blank image was printed, and the power for the image forming apparatus 1 was turned off while the paper P was passing a portion perpendicularly below the photosensitive drum 11, thereby compulsively stopping the apparatus. With this state, the toner on the surface of the photosensitive drum 11 after the development but before the transfer was attached to an adhesive tape (i.e., a Scotch Tape [trademark] made of 3M Japan Limited). The adhesive tape attached with the toner and an adhesive tape attached with no toner were pasted on the same paper, and a color difference Δ(delta) E*ab of the L*a*b color system of those adhesive tapes was measured using a spectral colorimeter (CM-2600d, Konica Minolta, Inc made). If the measured color difference ΔE*ab was equal to or less than 0.5, the image quality was judged as good, whereas if the color difference was more than 0.5, the image quality was judged as no good.

As a comparative example, substantially the same evaluations were made under a condition that the developer discharge shutter 90 of the image forming apparatus 1 was made in a normally open state.

Figure 8:
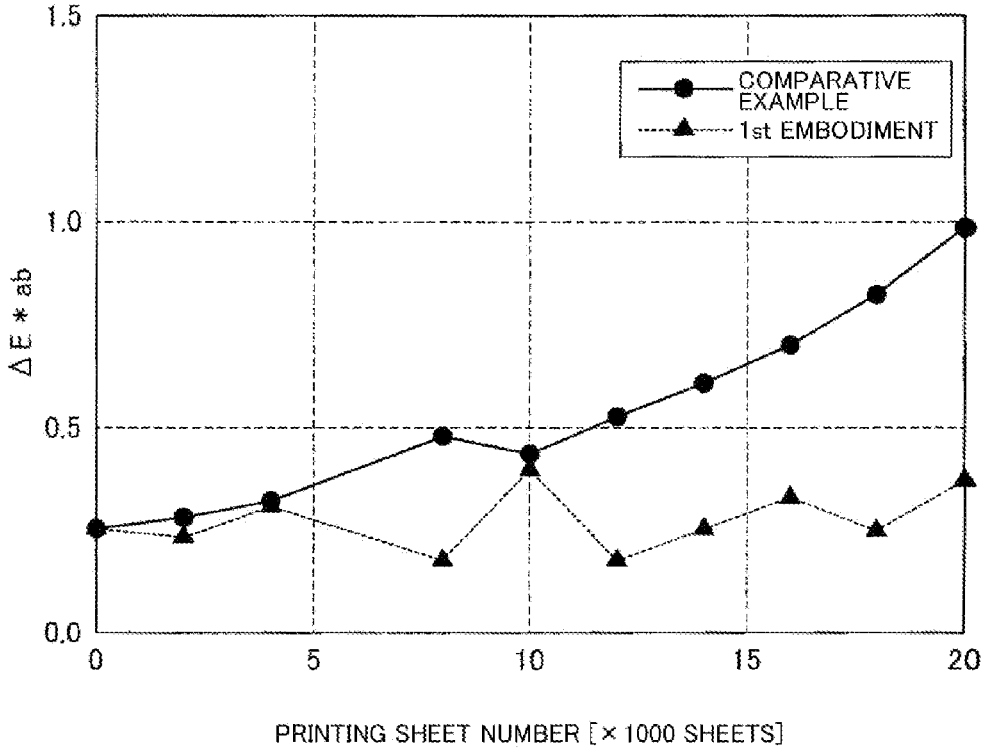
FIG. 8 is a diagram showing an evaluation result of the first embodiment and a compared example.

FIG. 8 shows evaluation consequences of the embodiment and the comparative example. For the comparative example, fogging was made worse at 12,000 sheets or later. It was assumed that this was caused from increased degraded toner carrier. To the contrary, this embodiment did not show any worse state of fogging even at 12,000 sheets or later, and obtained a good image quality even upon reaching 20,000 sheets.

As described above, the embodiment, under the trickle development method, is formed with the developer discharge shutter 90 (or namely the discharge prohibiting unit), and where the toner carrier C is supplied from the supply unit 70, discharge of the developer D from the discharge unit 80 is prohibited during the prescribed discharge prohibiting period. With this operation, the developing device can prevent newly just supplied toner carrier C from being discharged. Accordingly, the toner carrier C supplied can be used efficiently, and the developing device can obtain the good image quality for a long period of time, thereby making itself and the image forming apparatus having a longer duration.

According to the structure that discharge of the developer D is prohibited at the same time as the supply start of the developer D done by the supply unit 70, the toner carrier C supplied from the supply unit 70 can be prevented from discharged from the discharge unit 80 in passing through the opening 62*d* immediately after supply start.

Second Embodiment

Hereinafter, an image forming apparatus according to the second embodiment is described. The image forming apparatus has a different supply control of the developer D in comparison with the image forming apparatus according to the first embodiment, and other portions are substantially the same. In the following description, descriptions of portions substantially the same as those in the first embodiment are omitted or simplified, and elements the same as or corresponding to those in the first embodiment are given with the same reference numbers.

In this embodiment, if the judgment unit 122 judges that the developer D is to be supplied, the supply unit 70 supplies multiple times the developer D in a prescribed amount in an intermittent and dividing manner. For example, the supply unit 70 performs N times operation supplying the developer D in a supply amount of X/N (N is an integer of two or more) in a case where the developer D in a prescribed amount of X is supplied. More specifically, when judging that the developer D is to be supplied, the printing controller 112 decides an open time Ts of the developer supply shutter 74 according to the image data to be printed, and performs N times operation opening the developer supply shutter 74 only for a time of Ts/N.

Figure 9:
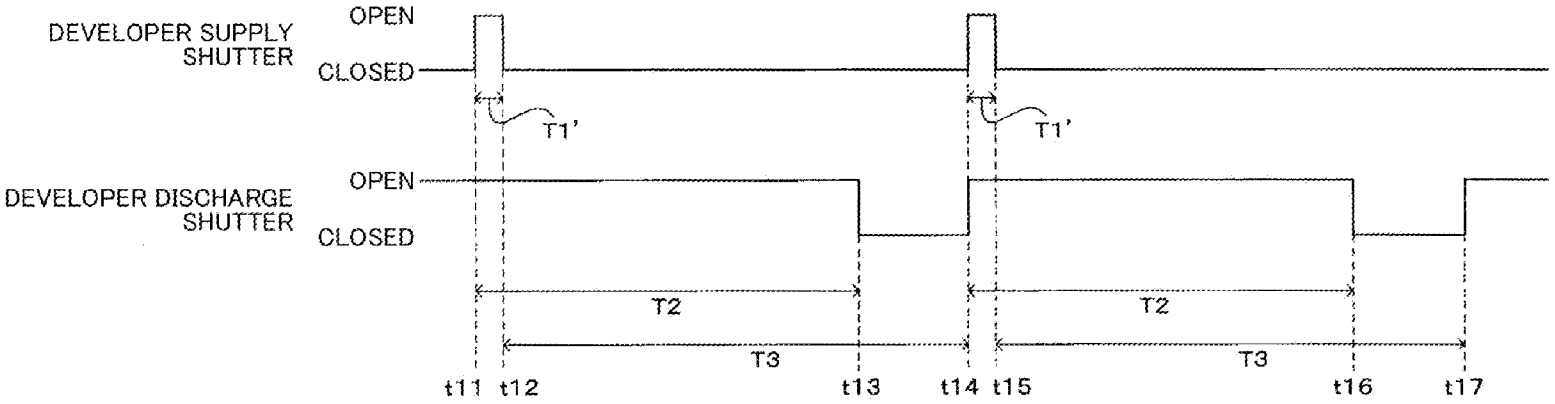
FIG. 9 is a control sequence diagram of a developer supply shutter and a developer discharge shutter according to a second embodiment.

FIG. 9 is a control sequence diagram of the developer supply shutter 74 and the developer discharge shutter 90 according to the second embodiment. FIG. 9 shows a situation that the developer D in the same amount as that in FIG. 6 is supplied in a manner dividedly twice.

The printing controller 112 makes open the developer supply shutter 74 at a timing t11, and makes closed the developer supply shutter 74 at a timing that the lapse time from the timing t11 reaches a time T1' (=T1/2), or namely at a timing t12. The printing controller 112 makes closed the developer discharge shutter 90 at a timing that the lapse time from the timing t11 reaches a time T2, or namely at a timing t13, and makes open the developer discharge shutter 90 at a timing that the lapse time from the timing t12 reaches a time T3 or namely at a timing t14.

The printing controller 112 starts the supply operation of the second time at the same time as the completion of the supply operation of the first time. The supply operation of the second time is substantially the same as the supply operation of the first time, and supply is made from a timing t14 to a timing t15 whereas discharge is prohibited from a timing t16 to a timing t17.

As described above, the developer D is supplied multiple times in a divided manner in this embodiment. That is, the developer D is supplied intermittently. With this operation, the developer D or the toner carrier C can be uniformly distributed in the circulation path 62*f* in comparison with the device supplying the developer D once. It is to be noted that the time interval of the supply may be set in an appropriate manner, and can be set longer or shorter than the time interval shown in FIG. 9.

Figure 10A:
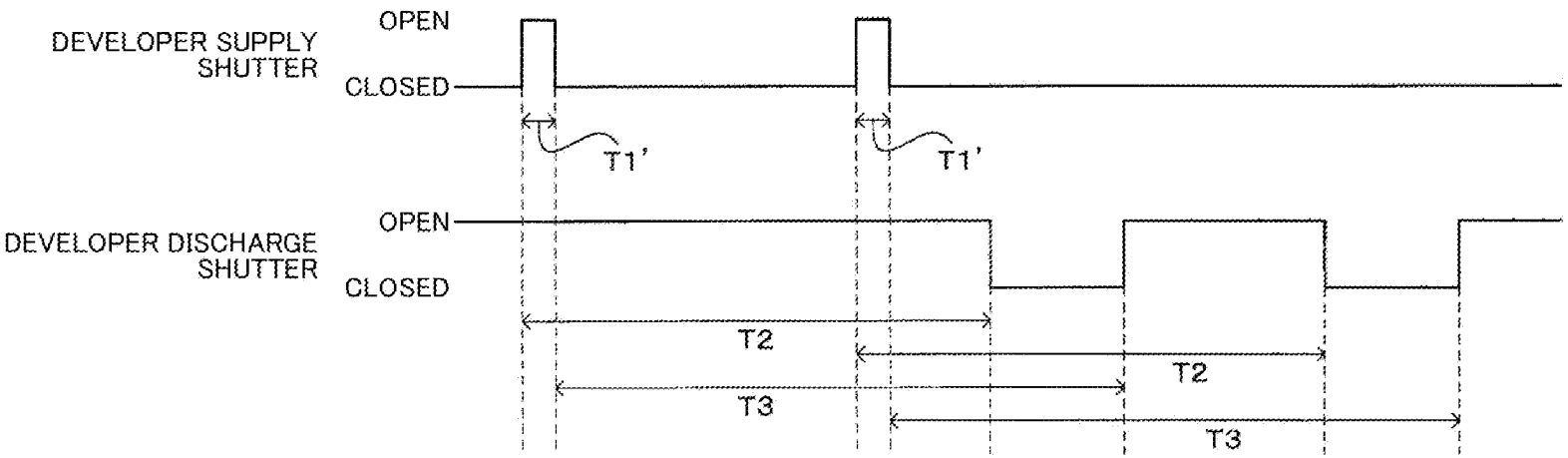
FIG. 10 A, 10B are control sequence diagrams of a developer supply shutter and a developer discharge shutter according to a modification of the second embodiment.
Figure 10B:
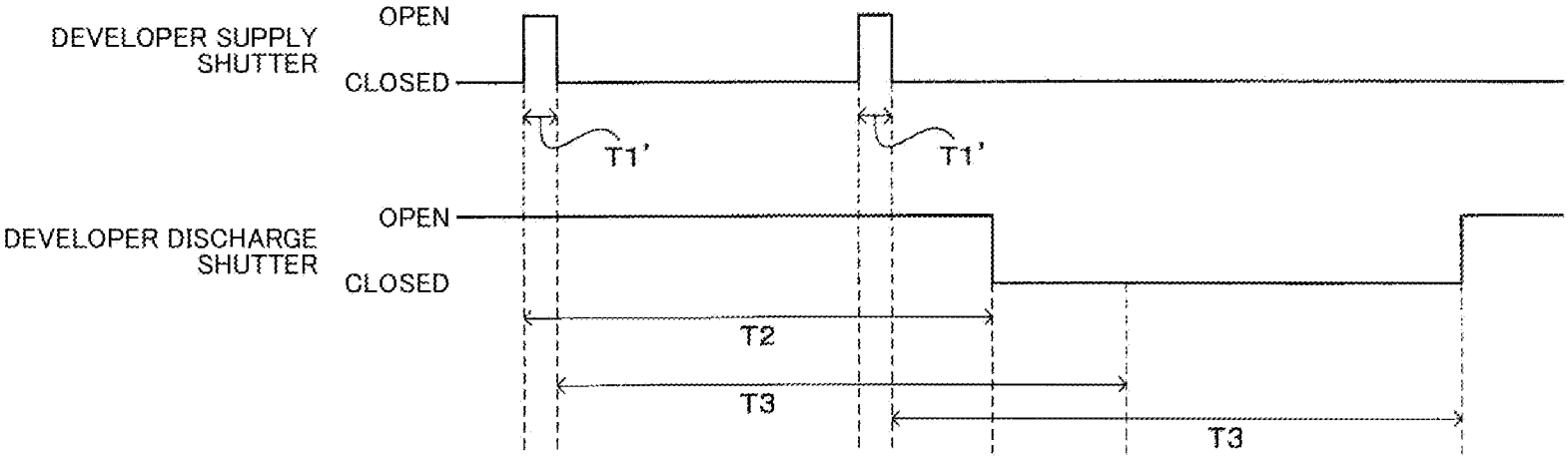

FIGS. 10A, 10B are control sequence diagrams of the developer supply shutter 74 and the developer discharge shutter 90 according to a modification of the second embodiment. In FIGS. 10A, 10B, the supply of the second time is done after the supply of the first time but before the developer discharge shutter 90 is made closed.

In FIG. 10A, the printing controller 112 performs opening and closing operations of the developer discharge shutter 90 according to the following rules (a1) to (a4):

(a1) starting the measurement of the lapse time To at a time opening the developer supply shutter 74;

(a2) starting the measurement of the lapse time Tc at a time closing the developer supply shutter 74;

(a3) closing the developer discharge shutter 90 when the lapse time To reaches the time T2; and (a4) opening the developer discharge shutter 90 when the lapse time Tc reaches the time T3.

In FIG. 10B, the printing controller 112 performs opening and closing operations of the developer discharge shutter 90 according to the following rule (a5) in addition to the rules (a1) to (a4):

(a5) resetting the measurement of the lapse time Tc and stopping operation, if the developer supply shutter 74 is made open again before the lapse time Tc reaches the time T3 after starting the measurement of the lapse time Tc.

Figure 11A:
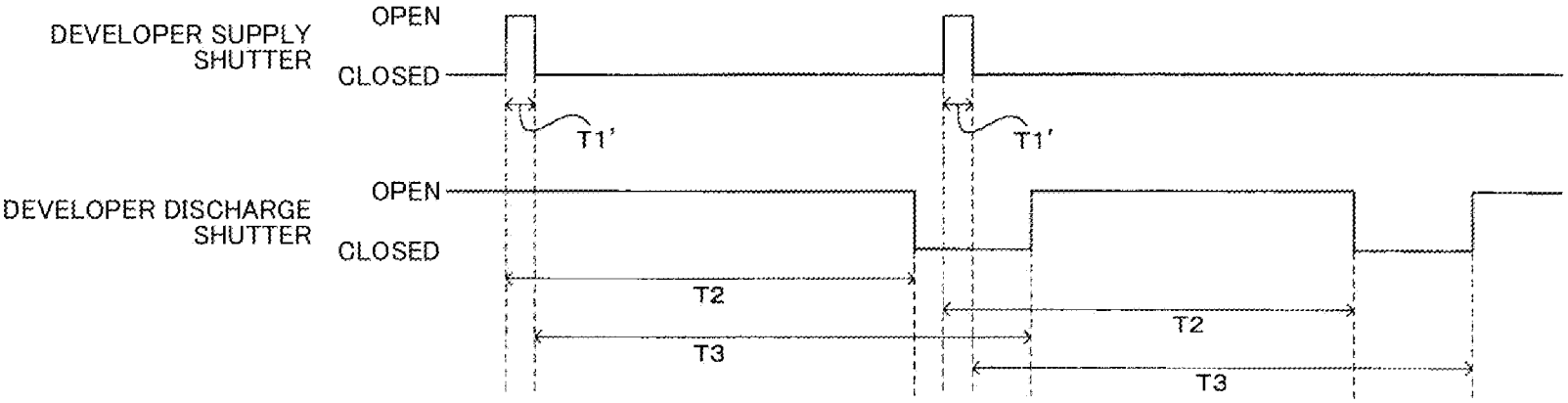
FIG. 11 A, 11B are control sequence diagrams of a developer supply shutter and a developer discharge shutter according to another modification of the second embodiment.
Figure 11B:
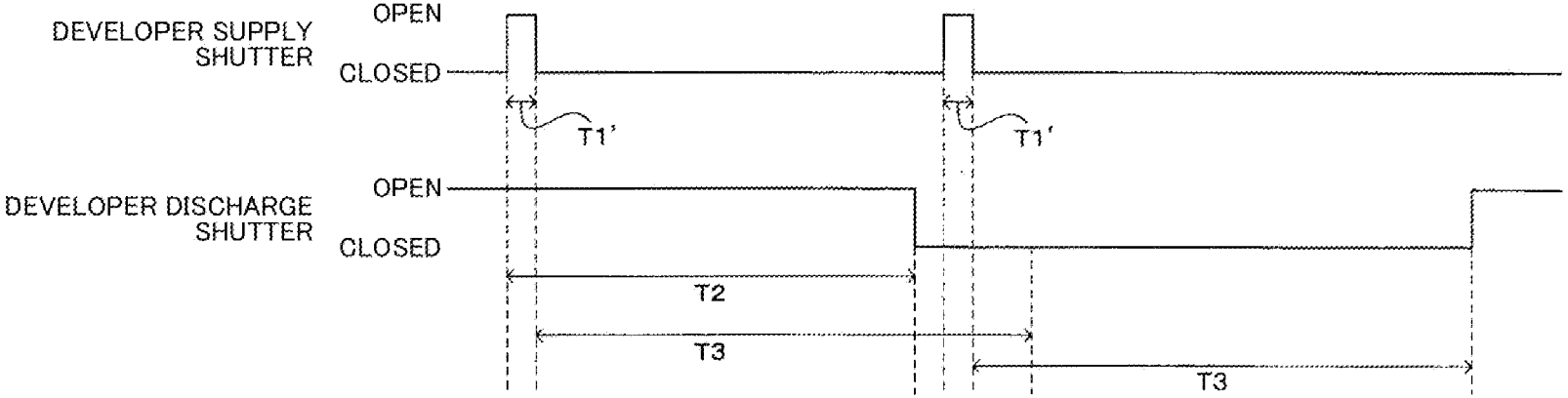

FIGS. 11A, 11B are control sequence diagrams of the developer supply shutter 74 and the developer discharge shutter 90 according to another modification of the second embodiment. In the modified example shown in FIGS. 11A, 11B, the supply of the second time is performed while the developer discharge shutter 90 is in the closed state after the supply of the first time is done. The opening and closing operations of the developer discharge shutter 90 is performed according to the above rules (a1) to (a4) in a device corresponding to FIG. 11A and according to the above rules (a1) to (a5) in a device corresponding to FIG. 11B, in a manner similar to those corresponding to FIGS. 10A, 10B.

Third Embodiment

Hereinafter, an image forming apparatus according to the third embodiment is described. This image forming apparatus is different from the image forming apparatus according to the second embodiment in respect with changing control of conveyance speed of the developer D, and other portions are substantially the same between the second and the third embodiments. In the following description, descriptions of portions substantially the same as those in the second embodiment are omitted or simplified, and elements the same as or corresponding to those in the second embodiment are given with the same reference numbers.

The printing controller 112 raises the conveyance speed of the developer D done by the developer conveyance screws 63, 64 during a prescribed period where the developer D is supplied from the supply unit 70. More specifically, the printing controller 112 increases the conveyance speed while the supply unit 70 supplies multiple times the developer D in the prescribed amount in a divided manner. The printing controller 112 increases the conveyance speed during the discharge prohibiting period. In this embodiment, the printing controller 112 increases the conveyance speed of the developer D between the start timing of the supply of the first time and the end timing of the discharge prohibiting period corresponding to the supply of Nth time, where the developer D is supplied N times in the divided manner.

Figure 12:
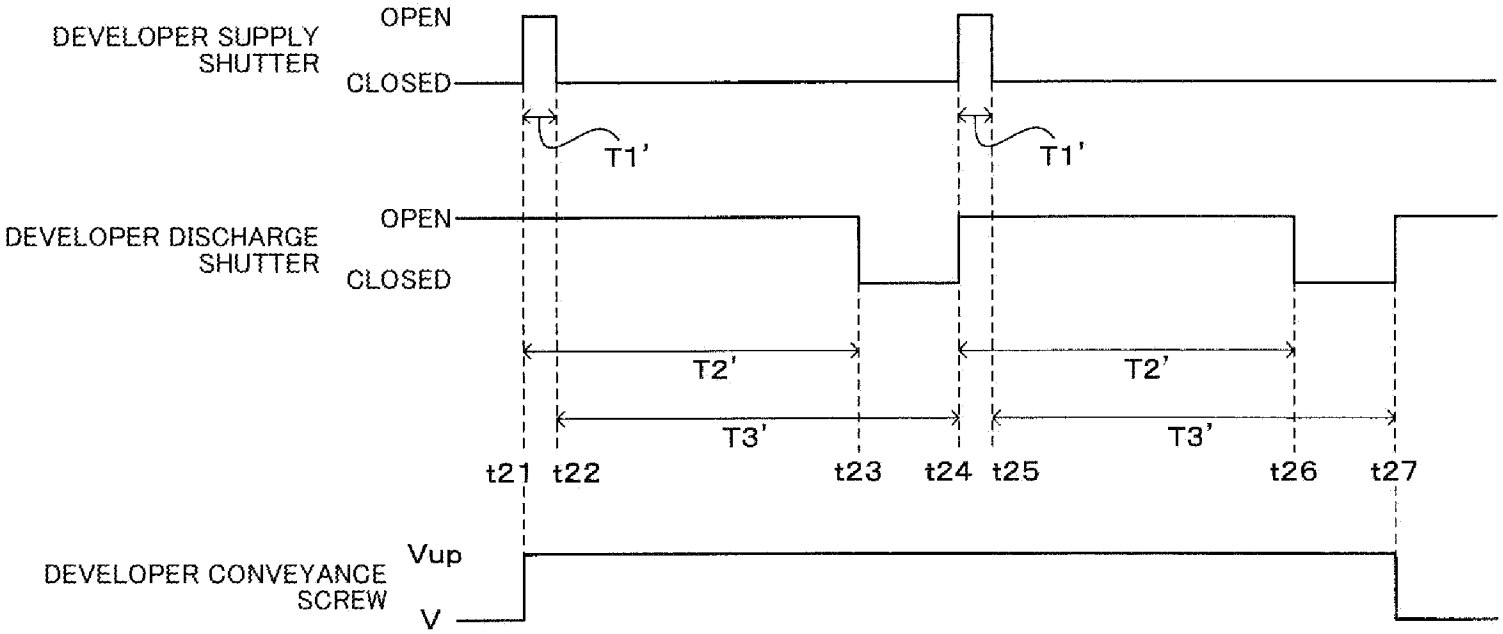
FIG. 12 is a control sequence diagram of a developer supply shutter, a developer discharge shutter, and developer conveyance screws according to a third embodiment.

FIG. 12 is a control sequence diagram of the developer supply shutter 74, the developer discharge shutter 90, and the developer conveyance screws 63,64 according to the third embodiment. FIG. 12 shows a situation in which the developer D in the same amount as that shown in FIG. 6 is supplied dividedly twice.

The printing controller 112 makes open the developer supply shutter 74 at a timing t21, and makes closed the developer supply shutter 74 at a timing that the lapse time from the timing t21 reaches a time T1' (=T1/2), or namely a timing t22.

The printing controller 112 changes the rotation speed of the developer conveyance screws 63, 64 from V to Vup, which is higher than V, at the same time as the opening of the developer supply shutter 74, or namely at the timing t21. With this change, the conveyance speed of the developer D is increased.

The printing controller 112 makes closed the developer discharge shutter 90 at a timing that the lapse time from the timing t21 reaches the time T2' or namely at a timing t23. In this embodiment, the time T2' is a required time that the toner carrier C supplied from the supply unit 70 reaches the discharge unit 80, and the timing t23 is a time point that the toner carrier C supplied from the supply unit 70 reaches the discharge unit 80. The required time may be measured through experiments or may be calculated. For example, where a distance along the circulation path 62*f* from the developer supply inlet 72 to the discharge developer selection path 81*a* is set to S, and where a conveyance speed of the toner carrier C is set to Vdup, the time T2' is calculated from a formula (iii) below.

$$T2'=S/Vdup \quad \text{(iii)}$$

The conveyance speed Vdup is a conveyance speed of the developer D where the rotation speed of the developer conveyance screws 63, 64 is Vup, and is measured through, e.g., experiments. The conveyance speed Vdup is higher than the conveyance speed of the developer D in which the rotation speed of the developer conveyance screws 63, 64 is V. If the distribution of the conveyance speed of the toner carrier C is considered, the minimum value of the conveyance speed distribution of the toner carrier C is used as Vdup of the formula (iii). If the conveyance speed distribution has a narrow width, an average value may be used.

The printing controller 112 makes open the developer discharge shutter 90 at a time that the time lapse from the timing t22 reaches the time T3' or namely at a timing t24. In this embodiment, the time T3' is a required time for the toner carrier C supplied from the supply unit 70 to circulate once around the conveyance path 62*f*, and the timing t24 is a time point that the toner carrier C supplied from the supply unit 70 circulates once around the conveyance path 62*f*. The required time may be measured through experiments or may be calculated. For example, where a length of the circulation path 62*f* is set to L, and where a conveyance speed of the toner carrier C is set to Vdup, the time T3' is calculated from a formula (iv) below.

$$T3'=L/Vdup \quad \text{(iv)}$$

In consideration of the distribution of the conveyance speed of the toner carrier C, the minimum value of the conveyance speed distribution of the toner carrier C is used for the conveyance speed Vdup in the formula (iv). In a case that the conveyance speed distribution has a narrow width, an average value may be used.

The printing controller 112 starts the supply operation of the second time at the same time as the completion of the supply operation of the first time. The supply operation of the second time is done in substantially the same way as the supply operation of the first time. The supply is made from the timing t24 to the timing t25, and the discharge is prohibited from the timing t26 to the timing t27.

The printing controller 112 controls the rotation speed of the developer conveyance screws 63, 64 to be back to V from Vup at the end timing of the discharge prohibiting period corresponding to the supply operation of the second time, or namely at the timing t27.

As described above, with this embodiment, the developer conveyance screws 63, 64 raise the conveyance speed of the developer D while the developer D in the prescribed amount is supplied dividedly multiple times from the supply unit 70. With this operation, the developing device can make shorter the time interval of the supply of the developer D in comparison with a device not increasing the conveyance speed, so that a desired toner density is adjustable in a short period of the time. The amount of the developer D per unit time to be sent to the first conveyance path 62*a* can be made much more, so that this developing device can suppress image failures from occurring due to shortage of the developer D.

With this embodiment, the developer conveyance screws 63, 64 raise the conveyance speed of the developer D during the discharge prohibiting period. This operation makes shorter the period prohibiting the discharge of the developer D in comparison with a device not increasing the conveyance speed.

It is to be noted that the features of the third embodiment are applicable to the first embodiment. That is, the image forming apparatus according to the first embodiment can be structured so as to increase the conveyance speed of the developer D by means of the developer conveyance screws 63, 64, during a prescribed period, where the developer D is supplied from the supply unit 70.

This invention is not limited to the embodiments described above and can be used in various forms and aspects as far as not deviated from the scope of the invention. For example, although in the above embodiments, the structure that the supply unit 70 supplies the developer D including the toner carrier C and the toner T is exemplified, the supply unit 70 may have a structure supplying at least the toner carrier C and may supply only the toner carrier C instead of the developer D. In such a case, a toner supply unit for supplying the toner T to the circulation path 62*f* may be formed as a separate part of the supply unit 70. The toner supply unit may supply the toner T via the developer supply inlet 72 or may supply the toner T from another portion different from the developer supply inlet 72. The timing supplying the toner T done by the toner supply unit can be the same timing as the timing of the supply of the toner carrier C by the supply unit 70 and can be a different timing. For example, the toner supply unit supplies the toner T when the toner density comes lower than a threshold value, while the supply unit 70 supplies the toner carrier C at each timing that the rotation time of the developer conveyance screws 63, 64 reaches a prescribed time.

In the embodiments described above, the monochrome type image forming apparatus having the single developing device, but this invention is applicable to multicolor image forming apparatuses having plural developing devices. This invention is also applicable to apparatuses other than printers, such as, e.g., photocopiers, facsimile machines, and MFPs (Multi-Function Peripherals)

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A developing device for developing latent images formed on an image carrier with a developer including toner carrier and toner, comprising:

a developer container containing the developer;

a developer conveying member conveying the developer contained in the developer container as stirring the developer to circulate the developer in a circulation path in the developer container;

a supply unit supplying at least the toner carrier to the circulation path;

a discharge unit for discharging excessive developer in the circulation path according to supply from the supply unit; and a discharge prohibiting unit prohibiting discharge of the developer from the discharge unit during a predetermined discharge prohibiting period in a case where the toner carrier is supplied from the supply unit.

2. The developing device according to claim 1, wherein the discharge prohibiting period includes at least a part of a period that the toner carrier supplied from the supply unit passes through the discharge unit.

3. The developing device according to claim 2, wherein a start timing of the discharge prohibiting period is prior to a timing that the toner carrier supplied from the supply unit reaches the discharge unit.

4. The developing device according to claim 3, wherein the discharge prohibiting period begins simultaneously when the supply unit begins supply of the toner carrier.

5. The developing device according to claim 2, wherein an end timing of the discharge prohibiting period is subsequent to a timing that the toner carrier supplied from the supply unit passes through the discharge unit.

6. The developing device according to claim 2, wherein an end timing of the discharge prohibiting period is subsequent to a timing that the toner carrier supplied from the supply unit circulates once around the circulation path.

7. The developing device according to claim 1, further comprising a judgment unit judging as to whether the developer is to be supplied based on use status of the developer in the circulation path, wherein the supply unit supplies the developer in a prescribed amount including the toner carrier and the toner to the circulation path when the judgment unit judges as that the developer is to be supplied.

8. The developing device according to claim 7, wherein the supply unit supplies multiple times the developer in the prescribed amount in an intermittently dividing manner.

9. The developing device according to claim 8, wherein the developer conveying member raises a conveyance speed of the developer while the supply unit supplies multiple times the developer in the prescribed amount.

10. The developing device according to claim 1, wherein the developer conveying member raises a conveyance speed of the developer during the discharge prohibiting period.

11. An image forming apparatus comprising:

an image carrier;

a latent image forming unit forming latent images on the image carrier; and a developing device developing the latent images formed on the image carrier with a developer including toner carrier and toner, the developing device comprising:

a developer container containing the developer;

a developer conveying member conveying the developer contained in the developer container as stirring the developer to circulate the developer in a circulation path in the developer container;

a supply unit supplying at least the toner carrier to the circulation path;

a discharge unit for discharging excessive developer in the circulation path according to supply from the supply unit; and a discharge prohibiting unit prohibiting discharge of the developer from the discharge unit during a predetermined discharge prohibiting period in a case where the toner carrier is supplied from the supply unit.

* * * * *